US006262687B1

(12) United States Patent
Bai et al.

(10) Patent No.: US 6,262,687 B1
(45) Date of Patent: Jul. 17, 2001

(54) TRACKING ANTENNA AND METHOD

(75) Inventors: Monty W. Bai, Scottsdale; Jeff P. de Guzman, Phoenix, both of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/648,572

(22) Filed: Aug. 25, 2000

(51) Int. Cl.[7] ..... H01Q 3/00
(52) U.S. Cl. ..... 343/757; 343/763; 343/882
(58) Field of Search ..... 343/757, 758, 343/759, 761, 763, 765, 766, 878, 880, 882; H01Q 3/00

(56) References Cited

U.S. PATENT DOCUMENTS 5,619,215 * 4/1997 Sydor ..... 343/766
6,188,367 * 2/2001 Morrison et al. ..... 343/765

* cited by examiner

*Primary Examiner*—Hoanganh Le
(74) *Attorney, Agent, or Firm*—Frank J. Bogacz

(57) ABSTRACT

An antenna (30) includes a gimbal structure (32) having a base (46) and first and second pivoting devices (52, 54) defining a first rotational axis (40). A reflector (36) is mounted to the pivoting devices for rotating about the first axis. Signals are routed from the base to a connector (68) mounted to the reflector with a cable (10) which is coiled around a second rotational axis (50) of the antenna.

17 Claims, 1 Drawing Sheet

TRACKING ANTENNA AND METHOD

The present invention relates in general to antennas, and more particularly to antennas having rotating or moving reflectors for tracking satellites and other objects.

Wireless communications systems are currently using satellites to facilitate the global exchange of information. Such systems often use Low Earth Orbiting (LEO) satellites which are linked to each other and to ground based stations to provide wireless access over most of the Earth's surface.

The ground stations use tracking antennas that follow the satellites as they send and receive communication signals. These signals are generated and/or processed by a control unit installed in the ground station. The signals are routed through an antenna cable to a rotating parabolic reflector, so that one end of the cable is fixed while the other is in almost constant motion. As a result, the cable is subjected to twisting and/or bending displacement that can wear out or break the cable, reducing the operating life and reliability of the antenna.

Previous antennas try to reduce the cable stress and wear by using sliding racks, restricted motion chain mechanisms, and other devices to control the cable's motion. However, these devices add a significant cost to the antenna's manufacture, and are subject to wearing out themselves.

there is a need for a more reliable antenna that reduces the stress and wear on the antenna cable without increasing the manufacturing cost of the antenna.

DETAILED DESCRIPTION OF THE DRAWINGS

In the figures, elements having the same reference numbers have similar functionality.

Figure 1:
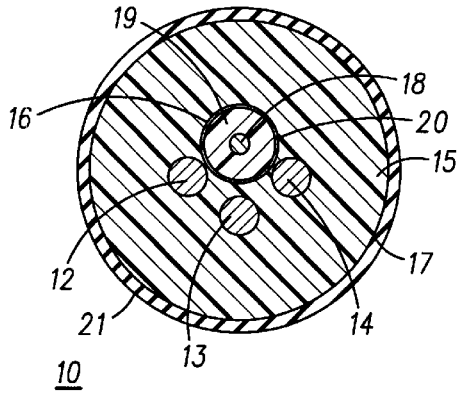
FIG. 1 is a cross sectional view of a cable.

FIG. 1 is a cross sectional view of a cable 10 suitable for routing signals and mounting to a tracking antenna's rotating parabolic reflector, including conductors 12–14, a coaxial cable 16 and a jacket 17. An optional insulating fill material 15 such as teflon is used to maintain electrical isolation among conductors 12–14 and coaxial cable 16.

Coaxial cable 15 comprises a standard coaxial transmission line that includes a conductor 18 and a concentric ground shield 20 separated by a dielectric 19. The impedance of coaxial cable 16 is a function of the radius of conductor 18 and ground shield 20 as well as the permittivity of dielectric 19, and is set to a value appropriate for a particular application. Dielectric 19 preferably comprises a low friction material such as teflon that reduces or eliminates a buildup of static charge due to the motion of cable 10.

Jacket 17 comprises nylon reinforced with glass fiber which can be molded or preformed to a desired geometry as described in detail below. In combination with conductors 12–14 and coaxial cable 16, jacket 17 produces a resiliency that allows cable 10 to retain its preformed geometry after being displaced. Jacket 17 has a slit 21 along its length to facilitate inserting conductors 12–14 and coaxial cable 16. Alternatively, jacket 17 is not slit, and conductors 12–14 and coaxial cable 16 are threaded through jacket 17 to form cable 10.

Figure 2:
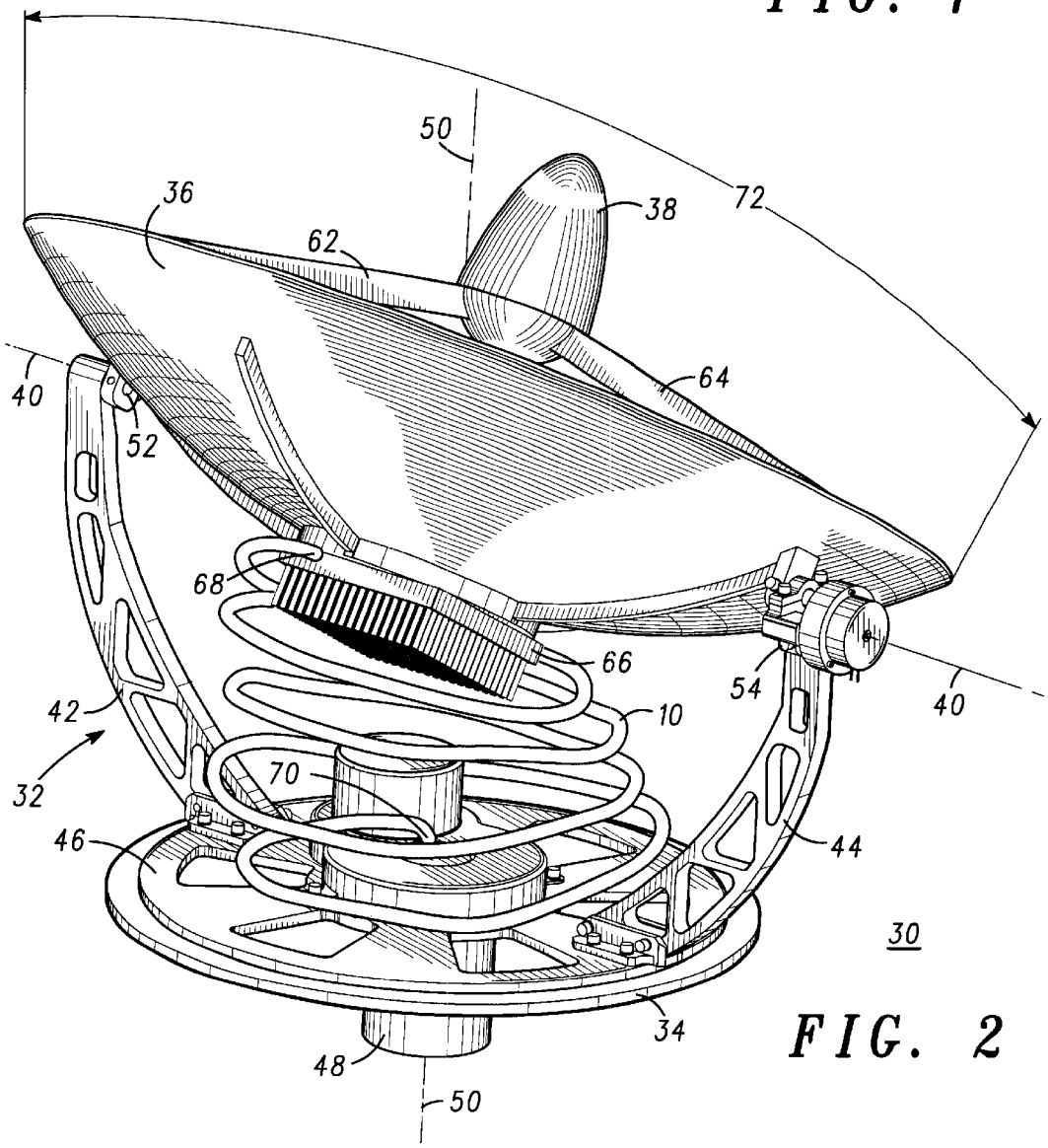
FIG. 2 is a perspective view of an antenna including the cable.

FIG. 2 is a perspective view of an antenna 30 configured as an azimuth–elevation antenna, including a gimbal structure 32, a base 34, a primary reflector 36, a secondary reflector 38 and cable 10. Antenna 30 tracks a satellite by rotating primary reflector 36 about two rotational axes, an elevation axis 40 for tracking the satellite's elevation and a zenith axis 50 for tracking its azimuth or angle. Such rotation maintains the satellite within an angle of visibility or aperture 72 of the antenna.

Primary reflector 36 is formed with a parabolic shape for directing uplink transmit signals and downlink receive signals. Uplink transmit signals are generated at a control unit of the ground station (not shown) and are routed through cable 10 to an electrical connector 68 of a power amplifier 66 attached to the underside of primary reflector 36. In one embodiment, the uplink transmit signals operate at twenty-nine gigahertz. Power supply, ground and control voltages similarly are routed through cable 10 to connector 68 of power amplifier 66.

Downlink receive signals are captured by primary reflector 36 and reflected to a receiver (not shown) housed within secondary reflector 38, which is mounted to primary reflector 36 with beams 62 and 64. Received signals are routed from connector 68 through cable 10 to the control unit (not shown). In one embodiment, the received signals operate at nineteen gigahertz.

Gimbal structure 32 includes braces 42 and 44 mounted to a turntable 46 to support primary reflector 36. Turntable 46 is disposed on a hub 48 that rotates with respect to base 34 about zenith axis 50 to provide azimuth tracking. A zenith point of antenna 30 is designated as a position in which primary reflector 36 is directed vertically so that zenith axis 50 is centered within aperture 72. In the embodiment of FIG. 2, antenna 30 rotates about zenith axis 50 within a range of plus and minus one hundred eighty degrees from the zenith point.

Pivot devices 52 and 54 are used for mounting primary reflector 36 to braces 42 and 44 such that primary reflector 36 pivots or rotates about elevation axis 40. The rotation is controlled by a servomotor 56 or similar device. In one embodiment, primary reflector 36 pivots about elevation axis 40 within a range of plus and minus seventy-five degrees of elevation from a neutral elevation. The neutral elevation occurs when primary reflector 36 is aimed vertically to receive the maximum power from directly above antenna 30, i.e., antenna 30 is directed to its zenith point. The rotation about axes 40 and 50 allows antenna 30 to track virtually any object whose elevation is at least fifteen degrees above the horizon.

Cable 10 is routed from an opening 70 in a designated location of base 46 to electrical connector 68. Opening 70 preferably is located at the center of base 46, so its position does not change as primary reflector 36 rotates. Because the position of electrical connector 68 is continuously shifting in accordance with the rotation of primary reflector 36, so that cable 10 is constantly being displaced and therefore subjected to bending and/or torsional displacements. Displacement due to azimuth rotation about zenith axis 50 predominantly induces a bending force on cable 10, while displacement due to elevation pivoting about elevation axis 40 predominantly induces a torsion force on cable 10. It can be shown that the bending and torsional displacements produce a shear stress which is a function of the effective length and bending radius of cable 10.

The present invention reduces the shear stress by coiling cable 10 as a spring around zenith axis 50. The coil geometry is achieved by preforming jacket 17 to a coil spring shape. The glass fiber–reinforced nylon of jacket 17 is selected to have a Young's modulus between $1.79*10^8$ and $2.41*10^8$ newtons per square meter to provide a high bending fatigue strength. A flexural strength between $6.89*10^9$ and $1.24*10^{10}$ newtons per square meter ensures that cable 10 retains its coil shape after being displaced.

At a position where antenna 30 is at its zenith point, or directed vertically, the geometry of cable 10 is generally cylindrical, which distributes the shear stress uniformly to minimize the stress at individual points along the length of cable 10. Cable 10 preferably is formed to have a large radius of curvature to minimize fatigue and increase the overall length, but not so large that cable 10 impinges on or rubs against braces 42 and 44 during displacement. In other words, cable 10 is coiled to a radius of curvature less than the radius of primary reflector 36.

By coiling cable 10 in such a cylindrical spiral geometry, the present invention eliminates the need to provide sliding racks, restricted motion chain mechanisms, or other devices needed by prior art antennas to reduce cable stress. As a result, the reliability of antenna 30 is maintained or improved while reducing the fabrication cost.

Cable 10 preferably is coiled so that a spacing is maintained between adjacent windings in order to avoid rubbing, binding or inductive coupling. A lighter weight or increased stiffness of cable 10 allows the number of windings to be increased while maintaining a space between windings. Additional windings have the benefit of increasing the overall length and further reducing fatigue due to shear stress.

Hence, it can be seen that the present invention substantially increases the reliability of a tracking antenna while reducing the cost of the antenna. A gimbal structure has a base and first and second pivoting devices. A reflector mounted to the first and second pivoting devices has a connector for receiving a signal. A conductor routed from the base to the connector is coiled around a rotational axis of the antenna in order to reduce shear stress on the cable without increasing the cost of the antenna.

It should be apparent that the teachings and principles of the present invention are not limited to the AZEL antenna described herein, but rather can provide a benefit to a wide variety of alternative antenna configurations. For example, a cable can be coiled about an elevation axis rather than a zenith axis of the antenna. Such a coil geometry can be used to improve the reliability of XY tracking antennas, which do not use a turntable, but rather have a gimbal structure with four pivot devices defining two orthogonal axes. The reflector pivots around either or both of the axes to provide an elevation displacement in both an X and a Y direction.

What is claimed is:

1. An antenna, comprising:

a gimbal structure having a base and a pivoting mechanism defining a first rotational axis of the antenna;

a reflector mounted to the gimbal structure for pivoting about the first rotational axis, the reflector having a connector for receiving a signal; and a conductor coiled around the first rotational axis of the antenna for routing the signal between the base and the connector.

2. The antenna of claim 1, further comprising a turntable for rotating the base of the gimbal structure about the first rotational axis of the antenna.

3. The antenna of claim 1, wherein the gimbal structure includes first and second pivoting devices for rotating the reflector about a second rotational axis of the antenna.

4. The antenna of claim 1, wherein the conductor is coiled to maintain a separation among windings as the reflector is rotated.

5. The antenna of claim 4, further comprising a jacket for housing the conductor to maintain the separation.

6. The antenna of claim 1, wherein the conductor comprises a transmission line for transferring a microwave signal to the connector.

7. The antenna of claim 1, wherein the conductor is coiled to a radius less than a radius of the reflector.

8. The antenna of claim 1, wherein the conductor is routed from the connector to an opening of the base.

9. An antenna, comprising:

a base;

a gimbal structure mounted to the base and having first and second pivot devices defining a first rotational axis of the antenna;

a reflector mounted to the first and second pivot devices for pivoting about the first rotational axis;

an amplifier mounted to the reflector for amplifying a microwave signal; and a cable for routing the microwave signal from the base to the amplifier, where the cable is coiled about a second rotational axis of the antenna.

10. The antenna of claim 9, where the amplifier includes a connector for receiving the microwave signal.

11. The antenna of claim 10, wherein the cable includes a coaxial transmission line for carrying the microwave signal.

12. The antenna of claim 9, wherein the cable is coiled such that a spacing is maintained between adjacent windings of the cable.

13. The antenna of claim 12, wherein the spacing is maintained as the reflector is rotated.

14. A method of tracking an object with an antenna, comprising the steps of:

transmitting and receiving signals with a reflector of the antenna to locate the object;

rotating the reflector about a first rotational axis of the antenna to maintain the object within an aperture of the antenna; and routing the signals from a base of the antenna to the reflector with a cable coiled around the first rotational axis.

15. The method of claim 14, further comprising the step of rotating the reflector about a second rotational axis of the antenna which is perpendicular to the first rotational axis.

16. The method of claim 15, wherein the step of routing includes the step of routing the signals from the base to an amplifier of the antenna.

17. The method of claim 16, wherein the step of routing further includes the step of routing the signals through an opening in the base.

* * * * *